US006909346B1

(12) United States Patent
Kornrumpf

(10) Patent No.: US 6,909,346 B1
(45) Date of Patent: Jun. 21, 2005

(54) SWITCHING ARRANGEMENT USING HDI INTERCONNECTS AND MEMS SWITCHES

(75) Inventor: William Kornrumpf, Schenectady, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 65 days.

(21) Appl. No.: 10/419,291

(22) Filed: Apr. 18, 2003

(51) Int. Cl.[7] ..... H01P 1/10
(52) U.S. Cl. ..... 333/262; 333/105
(58) Field of Search ..... 333/101, 105, 333/262; 200/181

(56) References Cited

U.S. PATENT DOCUMENTS 6,020,853 A * 2/2000 Richards et al. ..... 343/700 MS
6,104,934 A * 8/2000 Patton et al. ..... 455/561
6,525,623 B2 * 2/2003 Sridharan et al. ..... 333/128
6,714,169 B1 * 3/2004 Chau et al. ..... 343/876

* cited by examiner

*Primary Examiner*—Dean Takaoka
(74) *Attorney, Agent, or Firm*—Duane Morris LLP

(57) ABSTRACT

A transmission line structure includes first and second mutually separated strip conductors lying on an upper side of an upper dielectric sheet, and a ground conductor juxtaposed with the lower side of the upper dielectric sheet. A further strip conductor lies on a lower side of a lower dielectric sheet, with its ends registered with the ends of the first and second strip conductors. A gap in the further strip conductor is controllably bridged by a MEMS switch element, which may lie below the second dielectric sheet or in a cavity defined in the second dielectric sheet.

6 Claims, 8 Drawing Sheets

SWITCHING ARRANGEMENT USING HDI INTERCONNECTS AND MEMS SWITCHES

GOVERNMENTAL INTEREST

This invention was made with government support under Contract/Grant MDA972-00-C-0043 (DARPA). The United States Government has a non-exclusive, non-transferable, paid-up license in this invention.

FIELD OF THE INVENTION

This invention relates to switch arrangements which may be used for making andor breaking electrical connections, and more particularly to such switches using microelectromechanical (MEMS) devices in conjunction with high density interconnects (HDI).

BACKGROUND OF THE INVENTION

FIG. 1 is a simplified perspective or isometric view of a portion of a conventional "microstrip" transmission line 10. In FIG. 1, the structure 10 includes a planar dielectric plate 12. An elongated "strip" electrical conductor 14 extends over the upper surface 12*us* of the dielectric plate 12, and an electrically conductive "ground plane" 16 extends over the entirety of the lower surface 12*ls*, at least in the region generally under the strip conductor 14. Structure 10, and other generally similar structures such as "stripline," tend to constrain the electrical fields associated with propagating electromagnetic waves to lie principally in a portion of the dielectric plate 12 lying between the strip conductor 14 and the ground plane 16, all as is well known in the art. In order to prevent excessive transmission perturbations or "losses" attributable to reflections of propagating electromagnetic energy, the "surge" or "characteristic" impedance of a transmission line, such as transmission line 10 of FIG. 1, must be maintained along its length, or at the very least must change "slowly" along its length, where the rate of change of characteristic impedance is in part dependent upon the wavelength. The type of transmission line illustrated in FIG. 1 is one of those commonly used in High Density Interconnect (HDI) technology, which is useful when making very compact, complex or repairable electronic systems.

FIG. 2*a* is a simplified cross-sectional representation of a prior-art arrangement using a microelectromechanical (MEMS) switch in conjunction with high density interconnect (HDI) structures. MEMS structures are mechanical structures made, in general, by processes which are akin to those used to fabricate solid-state integrated circuits, including photolithography and resist, etching, multiple layers of material. In FIG. 2*a*, a transmission line 10 includes a layer of dielectric 12, which has a strip conductor 14 on its upper surface, extending front a left end LE to near a transverse plane T6. A ground plane or conductor 16 extends from the left edge LE to near a transverse plane T2. At the right end RE of FIG. 2*a*, a similar transmission line 210 includes a dielectric slab 212 defining an upper surface 212*us* and a lower surface 212*ls*, and a strip conductor 214 overlying upper surface 212*us* from near a transverse plane T14 to right end RE. A ground plane 216 extends below, and in contact with, lower surface 212*ls* from the right end RE to transverse plane T18.

A MEMS switch structure designated generally as 220 lies under HDI interconnect transmission-line structures 10 and 210 in FIG. 2*a*. MEMS switch structure 220 includes a MEMS dielectric substrate 222 defining an upper surface 222*us* and a lower surface 222*ls*. The movable mechanical element in MEMS structure 220 is illustrated as an electrically conductive switch contact 224, which is fabricated so that a drive structure (not illustrated in FIG. 2*a*) can cause it to move upward and downward (relative to the orientation of the FIGURE) in the direction of double-headed arrow 250. In order to incorporate the movable element 224 into a transmission line, a further strip conductor 234 is deposited on or otherwise supported by the upper surface 222*us* of dielectric plate 222, extending partially under movable switch element 224, with a break 235 in the continuity of strip conductor 234 generally at the location of the movable element 224. When the movable element 224 is in its uppermost state or condition, which is the position illustrated in FIG. 2*a*, there is no continuity between the left and right portions of strip conductor 234, and the switch is therefore OPEN or nonconductive. Conversely, when the movable conductor element 224 is in its lowermost state or condition, it is in contact with both left and right halves or portions of strip conductor 234, and provides electrical continuity therebetween. In this state, the switch is said to be CLOSED. It should be noted in passing that European usage looks on a switch as one might a gate, and a nonconductive state is known as CLOSED, while the conductive state is known as OPEN. Movable switch element 224 is controlled to the UP or DOWN state by MEMS controllers, not illustrated.

In order to avoid transmission-line discontinuities which might perturb proper transmission, it is desirable to have strip conductor 234 of FIG. 2*a* in the form of a transmission line. The transmission line of MEMS structure 220 includes a further ground plane 226 lying below lower surface 222*ls* of MEMS substrate 222, at least in the region lying below strip conductor 234 and movable element 224.

In order to provide a space or "room" for the desired movement of movable conductive element 224 of the MEMS structure 220, a layer 240 of dielectric is placed between the transmission line structure 210 and the MEMS structure 220, with a gap or opening 242 at the location of movable element 224. Finally, the connections are completed by a plurality of through vias and metallizations. More particularly, a through via 250 extends at transverse plane T2 from ground plane 16 to a metallization 251, and a further through via 252 extends at a transverse plane T4 from metallization 251 to ground plane 226. Thus, the combination of through vias 250 and 252, in conjunction with metallization 251, provides contact between the right-most end of ground plane 16 and the left-most end of ground plane 226. In addition, a through via 256 extends at transverse plane T18 from ground plane 216 to a metallization 257, and a further through via 254 extends at a transverse plane T16 from metallization 257 to ground plane 226. Thus, the combination of through vias 254 and 256, in conjunction with metallization 257, provides contact between the left-most end of ground plane 216 and the right-most end of ground plane 226. Some strip conductor connections are made by means of a through via 260 extending at a plane T6 through dielectric plate 12 to a metallization 261, and a further through via 262 extending through dielectric plate 240 at plane T8 from metallization 261 to the left-most end of strip conductor 234. The strip conductor connections are completed by means of a through via 266 extending at a plane T14 through dielectric plate 212 to a metallization 267 lying between dielectric plates 212 and 240, and a further through via 254 extending at a plane T12 through dielectric plate 240 to the right-most end of strip conductor 234. Thus, through vias 264 and 266, in conjunction with metallization 267, provides electrical continuity from strip conductor 214 to the right end of strip conductor 234. In general, it may be said that the fields associated with a propagating electromagnetic wave are constrained to lie between the strip conductor/ground plane sets 14,16; 234, 226; 214, 216.

FIG. 2*b* illustrates the electric field resulting at transverse plane T1 of FIG. 2*a* from application of a direct voltage to strip conductor 14 relative to ground 16 of FIG. 1*a*. In FIG. 2*b*, the dielectric 12 is not hatched, in order to make the electric field lines 290 more visible. As illustrated, the electric field lines 290 extend from the strip conductor 14, principally through the dielectric material 12, and terminate on ground conductor or plane 16. FIG. 2*c* illustrates the electric field resulting at transverse plane T9 of FIG. 2*a* from application of a direct voltage to strip conductor 14 relative to ground 16 of FIG. 1*a*. As illustrated, the electric field structure 292 of FIG. 2*c* is virtually identical to that of FIG. 2*b*, with the field lines extending principally through the dielectric material 222 from the strip conductor 234 to the ground plane 226. The similarity of the field structure is an indication that the surge impedance of this section of transmission line is similar to that of the section illustrated in FIG. 2*b*.

SUMMARY OF THE INVENTION

In general, the invention relates to a transmission line structure including first and second mutually separated strip conductors lying on an upper side of an upper dielectric sheet, and a ground conductor juxtaposed with the lower side of the upper dielectric sheet. A further strip conductor lies on a lower side of a lower dielectric sheet, with its ends registered with the ends of the first and second strip conductors. In one embodiment, a gap in the further strip conductor is controllably bridged by a MEMS switch element, which may lie below the second dielectric sheet or in a cavity defined in the second dielectric sheet.

A transmission-line structure according to an aspect of the invention comprises a first dielectric sheet defining first and second broad sides. The first broad side of the first dielectric sheet bears first and second separate electrically conductive planar strips. Each of the separate electrically conductive planar strips defines at least a first end. The first end of the first planar strip and the first end of the second planar strip are spaced apart by a distance. A second dielectric sheet defines first and second broad sides. The first broad side of the second dielectric sheet defines a single continuous electrical conductor which defines first and second nonconductive regions. The first and second nonconductive regions are spaced apart by about the distance. The first broad side of the second dielectric sheet is juxtaposed with the second broad side of the first dielectric sheet, with at least portions of the first and second nonconductive regions of the continuous electrical conductor registered with the first ends of the first and second planar strips, respectively. The transmission-line structure also includes a nonconductive planar surface bearing a third electrically conductive planar strip defining first and second ends. The first and second ends of the third planar strip are separated by about the distance. The nonconductive planar surface is associated with the second side of the second dielectric sheet, with the first and second ends of the third planar strip registered with the first ends of the first and second planar strips, respectively. A first electrically conductive through via arrangement connects the first end of the first planar strip to the first end of the third strip through the first nonconductive region. A second electrically conductive through via arrangement connects the first end of the second planar strip to the second end of the third strip through the second nonconductive region, to thereby form the first, second and third planar strips into a continuous strip conductor in which at least a portion of each of the first, second and third planar strips overlies a side of the continuous electrical conductor to thereby form a strip transmission line including at least portions of the first, second and third planar strips.

A preferred embodiment of the transmission-line structure further includes a gap in the third planar strip, and mechanically operated switch means making controllable electrical and mechanical contact with a portion of the third planar strip on each side of the gap. In one version of this preferred embodiment, the mechanically operated switch means lies on a side of the gap which is remote from the first dielectric sheet, and moves toward and away from the second dielectric sheet in order to make and break connection. In another version of this preferred embodiment, the mechanically operated switch means lies within a cavity defined in the second dielectric sheet.

Another embodiment of the transmissionline structure includes a gap in the third planar strip, and a planar signal processing module with at least first and second signal ports. The first and second signal ports are mechanically and electrically connected to portions of the third planar strip on each side of the gap. In a preferred version of this embodiment, the signal processing module performs amplification, and the first and second signal ports are signal input and output ports, respectively.

DESCRIPTION OF THE INVENTION

Figure 3A:
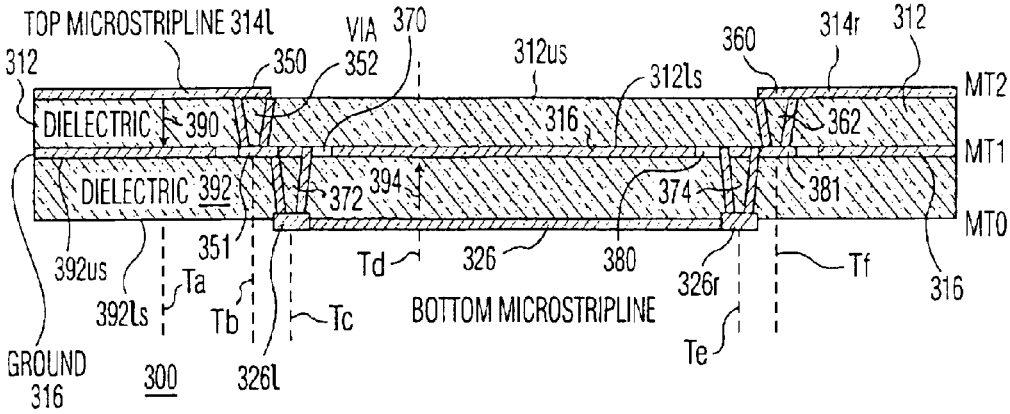
FIG. 3*a* is a simplified cross-sectional view of a transmission line structure according to an aspect of the invention.
Figure 3B:
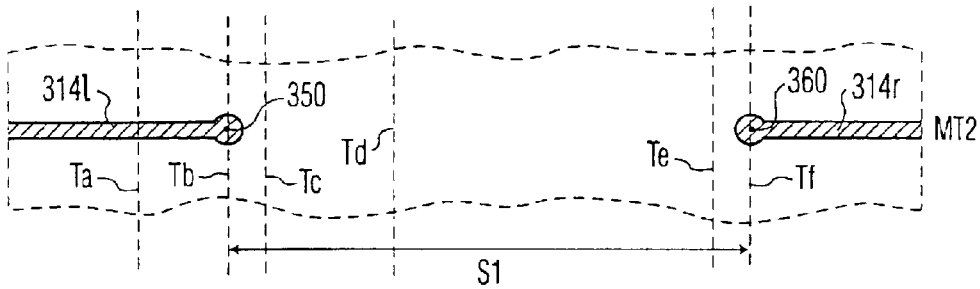
FIGS. 3*b*, 3*c*, and 3*d* are plan views of various layers of the structure of FIG. 3*a*, and FIGS. 3*e* and 3*f* are representations of the electric field structure at different locations along the structure of FIGS. 3*a*, 3*b*, 3*c*, and 3*d;*

FIG. 3*a* is a simplified cross-sectional illustration of a transmission-line arrangement according to an aspect of the invention, including upper and lower dielectric layers 312 and 392, respectively. The lower surface of dielectric layer 312 is designated 312*ls* The upper surface of dielectric layer 312 is designated 312*us*, and bears a pattern MT2 of metallization which is illustrated in plan view in FIG. 3*b*. The metallization layer MT2 includes a left-most top microstrip conductor 314*l* and a corresponding right-most microstrip conductor 314*r*. In FIG. 3*b*, the metallization portion is hatched, to aid in visualizing the metallization portion separated from the upper surface 312*us* of dielectric sheet 312. As illustrated in FIG. 3*b*, strip conductor or top microstripline 314*l* terminates at a transverse plane Tb in an enlarged pad 350, provided to aid in registering the various layers together, and possibly to provide some excess capacitance to aid in impedance matching. Similarly, right strip conductor 314*r* terminates at a transverse plane Tf in an enlarged pad 360. The distance between transverse planes Tb and Tf is designated S1.

Figure 3C:
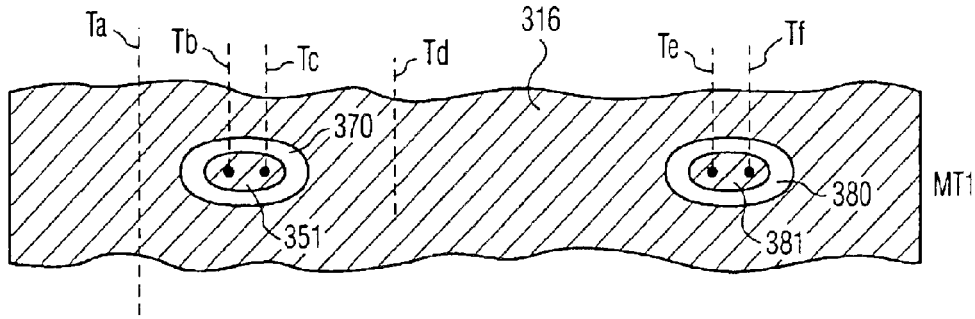

FIG. 3*c* illustrates the conductor pattern of metallization layer MT1, which lies between dielectric layers 312 and 316 of FIG. 3*a*. As illustrated in FIG. 3*c*, almost the entire surface or plane MT1 is occupied by a conductive ground plane 316. Near transverse planes Tb and Tc, an opening 370 provides clearance for a pad 351, which extends at least from transverse plane Tb to transverse plane Tc, in a manner which is isolated from ground conductor 316. Similarly, at transverse planes Te and Tf, an opening 380 provides clearance for a pad 381, which extends at least from transverse plane Te to transverse plane Tf, also isolated from ground conductor 316. Pads 351 and 381 provide terminals for plated-through vias which make connections among the layers of metallization. More particularly, a through via 352 extends from upper-layer pad 350 through dielectric layer 312 to central-layer pad 351 at transverse plane Tb, and a through via 362 extends at transverse plane Tf through dielectric layer 312 to make electrical connection between upper-layer pad 360 and middle-layer pad 381.

Figure 1:
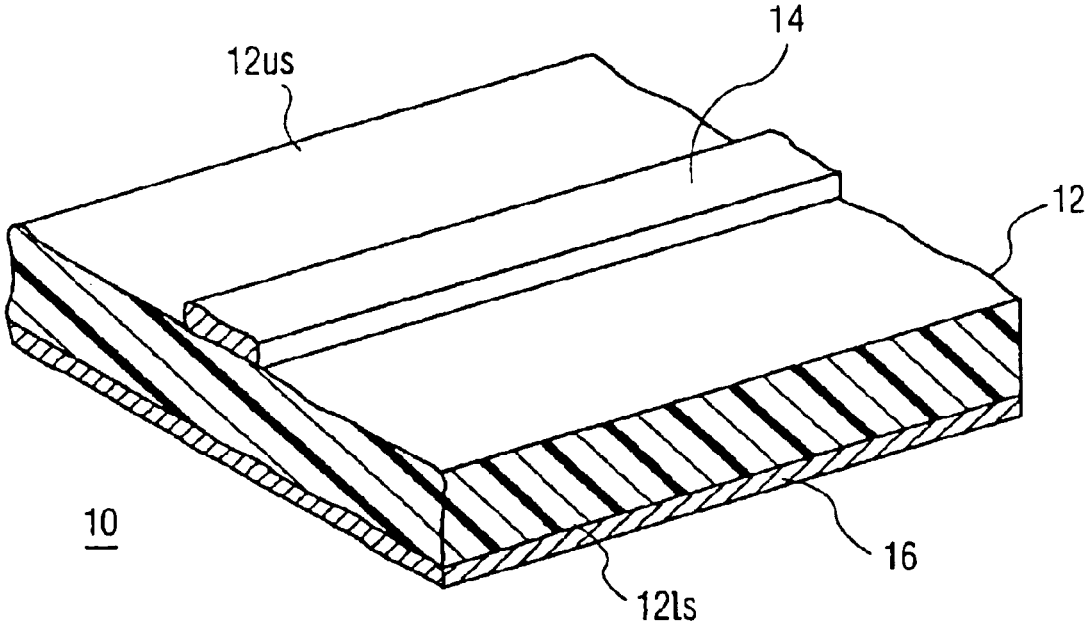
FIG. 1 PRIOR ART
FIG. 1 is a simplified perspective or isometric view of a portion of a prior-art transmission line.
Figure 2A:
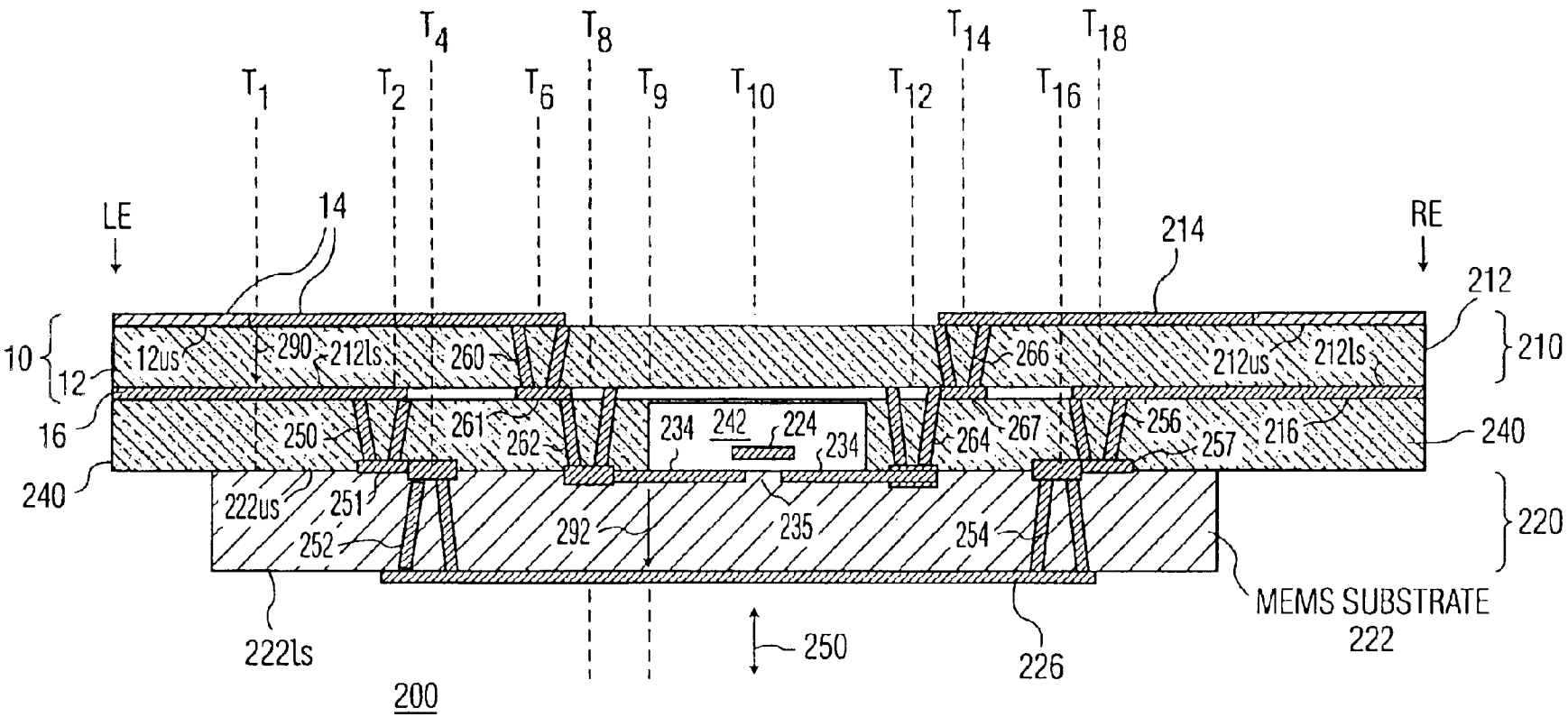
FIG. 2A PRIOR ART
FIG. 2*a* is a simplified cross-sectional view of a prior-art transmission-line switch including a MEMS switch in an HDI structure.
Figure 2B:
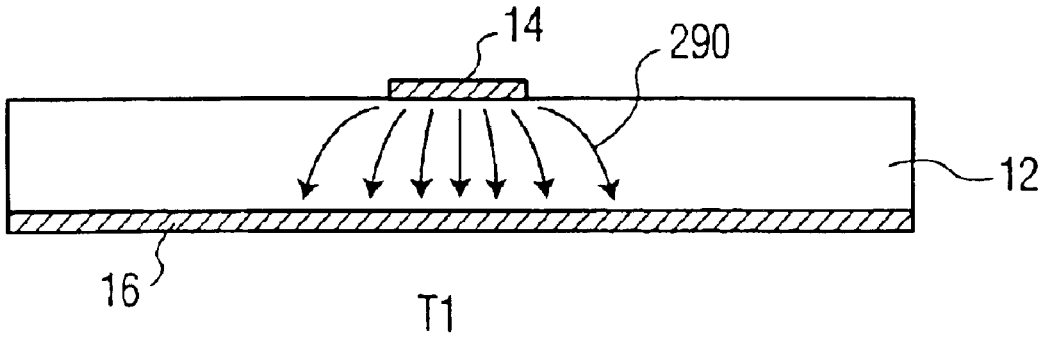
FIG. 2B PRIOR ART
FIG. 2*b* is a representation of the electric field structure at a first location along the structure of FIG. 2*a*.
Figure 2C:
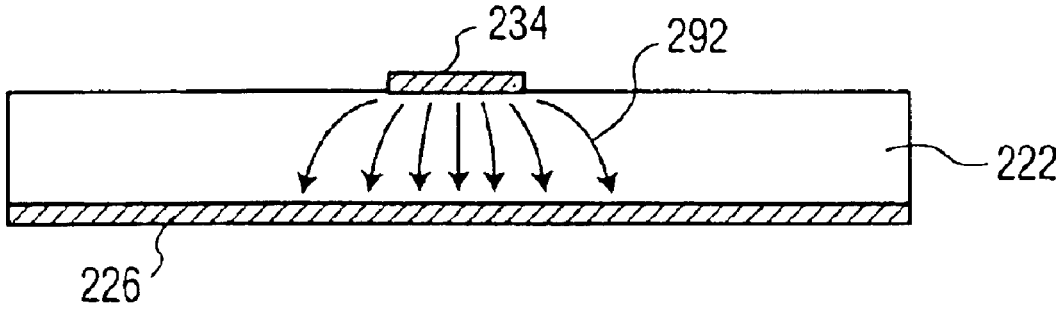
FIG. 2C PRIOR ART
FIG. 2*c* is a representation of the electric field structure at a second location along the structure of FIG. 2*a;*
Figure 3D:
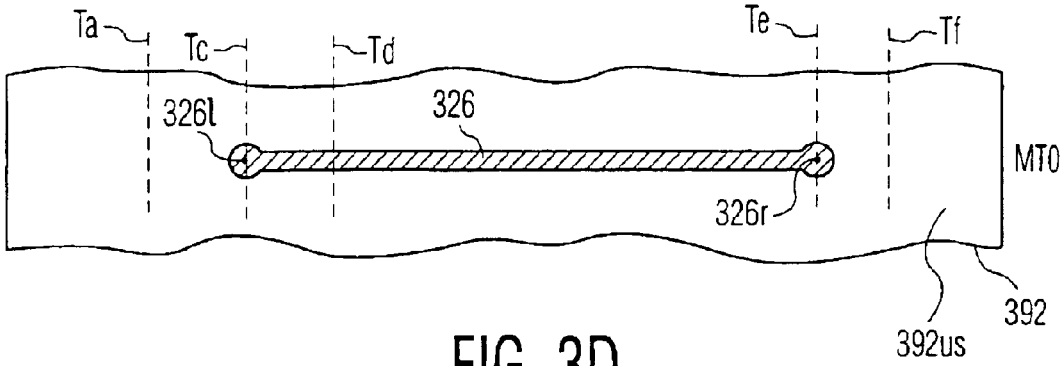
Figure 3E:
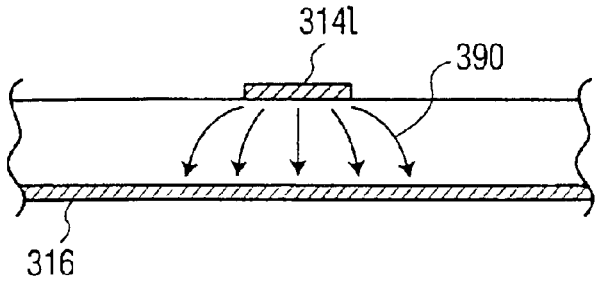
Figure 3F:
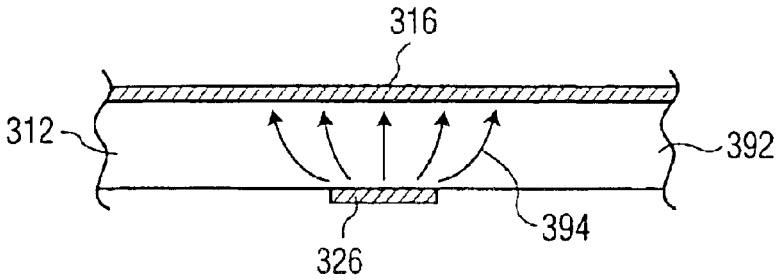

FIG. 3*d* illustrates in plan view the conductive or metallization pattern of bottom layer MTO of FIG. 3*a*. In FIG. 3*d*, a strip conductor 326 extends from a pad 326*l* at transverse plane Tc to a corresponding pad 326*r* at plane Te. Thus, pad 326*l* lies under a portion of pad 351 of FIG. 3*c*, and pad 326*r* lies under a portion of pad 381. As illustrated in FIG. 3*a*, a plated-through or conductive via 372 extends at transverse plane Tc from upper surface 392*us* through dielectric layer 392 to lower surface 392*ls*, to electrically interconnect middle-layer metallization 351 to lower-level metallization pad 326*l*. Similarly, a plated-through or conductive via 374 extends at transverse plane Te through dielectric layer 392 to electrically interconnect middle-layer metallization 381 to lower-level metallization pad 326*r*. Thus, a voltage applied to upper or top level strip conductor 314*l* of FIG. 3*a* relative to ground 316 creates a field pattern at a transverse plane Ta which is illustrated in FIG. 3*e*. In FIG. 3*e*, the electric field lines 390 extend from the strip conductor 314*l*, principally through the dielectric material 312, and terminate on ground conductor or plane 316. Comparison of FIGS. 2*b* with 3*e* shows that the field patterns are similar, so that the structure of FIGS. 3*a*, 3*b*, 3*c*, and 3*d* at transverse plane Ta corresponds to the structure of FIG. 2*a* at transverse plane T1. Also, a voltage applied to upper or top level strip conductor 314*l* of FIG. 3*a* relative to ground 316 creates a field pattern at a transverse plane Td of FIG. 3*d* which is illustrated in FIG. 3*f*. In FIG. 3*f*, the electric field lines 394 extend from the strip conductor 326, principally through the dielectric material 392, and terminate on ground conductor or plane 316. Comparison of FIGS. 3*e* with 3*f* shows that the field patterns 390, 394 are similar, except for the physical positions of the strip conductors 314*l*, 326, respectively, relative to the ground plane 316. since the physical position of components has no effect on electrical systems other than as it affects the field structure (in other words, gravity has no effect on the electrical performance), the structure of FIGS. 3*a*, 3*b*, 3*c*, and 3*d* at transverse plane Td corresponds to that at transverse plane Ta.

Figure 4A:
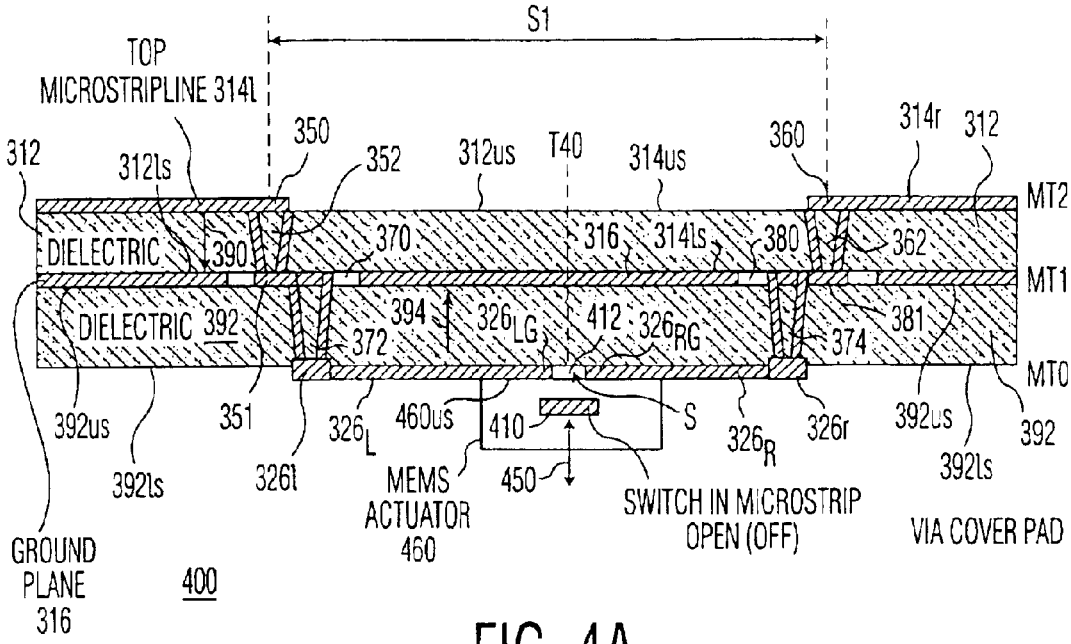
FIG. 4*a* is a simplified representation of a transmission-line structure similar to that of FIGS. 3*a*, 3*b*, 3*c*, and 3*d*, with the inclusion of a movable MEMS switch element in the open or OFF state.
Figure 4B:
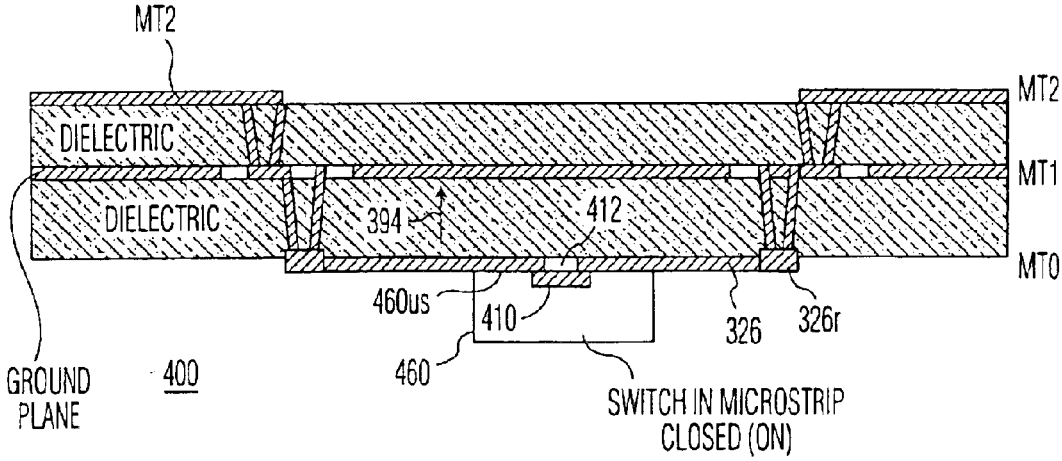
FIG. 4*b* is similar to FIG. 4*a* but shows the switch element in the closed or ON state.

FIGS. 4*a* and 4*b* are similar to FIG. 3*a*, and corresponding parts or elements are designated by like reference designations or alphanumerics. The arrangement of FIG. 4*a* includes a break, opening or nonconductive portion 412 of conductor strip 326 at or near a transverse plane T40, which divides conductor strip 326 into a left portion $326_L$ and a right portion $326_R$. A MEMS switch element in the form of a conductive strip 410 is positioned below opening 412, and arranged by a MEMS actuator 460 for motion in the direction of double-headed arrow 450 between the illustrated position with conductive element 410 not in electrical contact with conductor 326 and a second position, illustrated in FIG. 4*b*, in which conductive element 410 is in contact with strip conductor $326_L$, $326_R$ on both sides of break 412. Microelectromechanical actuators for accomplishing such motion are known in the art. The length of break 412 is a distance S, which is less than the length of movable element 410. In the "making contact" position of conductive element 410 illustrated in FIG. 4*b*, the opening or break 412 is bridged by conductive element 410, thereby providing a path for the flow of electric current along the strip $326_L$, $326_R$. The state of the switch element represented by FIG. 4*a* is nonconductive, OPEN or OFF, and the state of the switch element represented by FIG. 4*b* is conductive, CLOSED or ON. Thus, motion of a conductive element driven by a MEMS actuating device relative to a gap in a conductor can cause the transmission-line structure of FIG. 3*a* to act effectively as a switch having ON and OFF states.

Figure 5A:
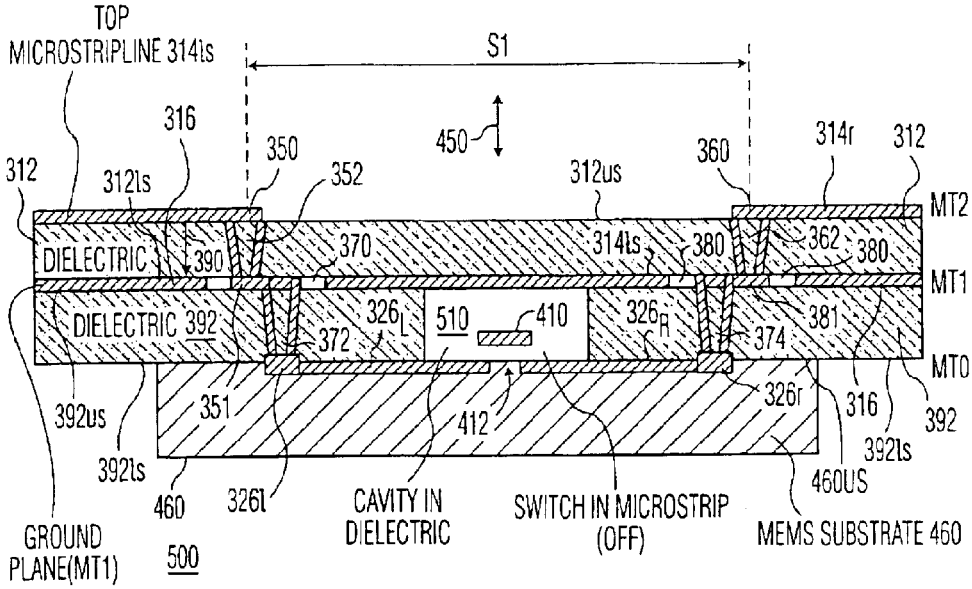
FIG. 5*a* is a simplified representation of a transmission-line structure similar to FIG. 4*a*, but has the movable MEMS switch element lying in a cavity defined in a dielectric layer.

FIG. 5*a* is a simplified cross-sectional view of a switch 500 generally similar to switch 400 of FIG. 4*a*, and in which like reference designations refer to the same elements. The arrangement of FIG. 5*a* differs from that of FIG. 4*a* in that the movable MEMS switch element 410 lies above strip conductor portions $326_L$ and $326_R$, rather than below. The motion of movable MEMS element 410 continues to be in the direction indicated by arrow 450. In order to provide space for movable MEMS switch element 410, a cavity designated generally as 510 is defined in dielectric sheet or layer 392 in the region around movable MEMS switch element 410.

Figure 5B:
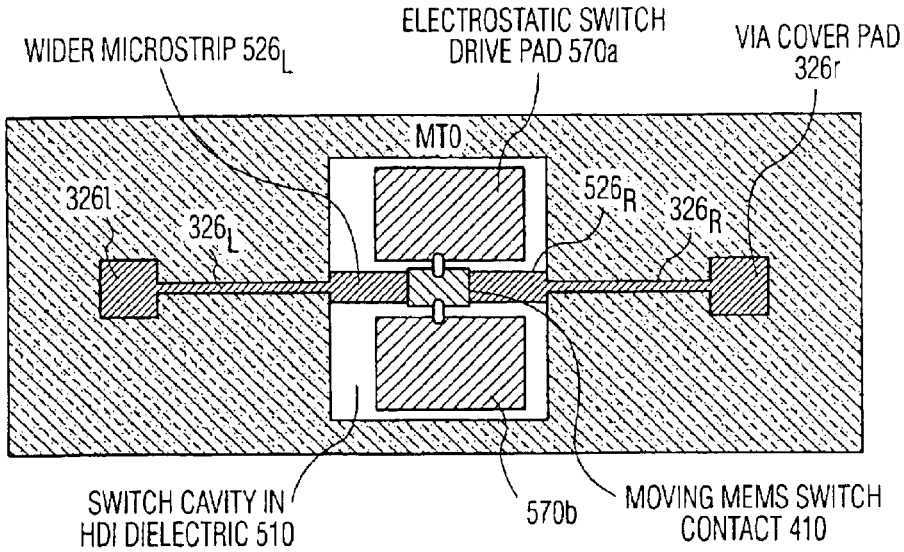
FIG. 5*b* is a plan view of the structure of FIG. 5*a*, showing a particular layer of conductors.

Those skilled in the art of transmission lines know that the removal of dielectric material from a location adjacent the strip conductor tends to reduce the capacitance per unit length of the transmission line including the strip conductor, thereby tending to make the transmission line "inductive" or higher impedance in the affected region. In order to compensate for the effects of removing dielectric from dielectric sheet or plate 392 in the region around movable MEMS switch element 410, the strip conductor is made wider than it would otherwise be. FIG. 5*b* is a plan view of layer MT0 of FIG. 5*a*, showing the left and right strip conductors, and also showing the location of cavity 510. In the region of cavity 510, the wider portion of strip conductor $326_L$ is designated $526_L$, and the wider portion of strip conductor $326_R$ is designated $526_R$. In order to maintain the impedance of the transmission line structure in the region of the movable MEMS switch element 410, the element itself is made to a width about equal to that of the wider portions $526_L$ and $526_R$. Also illustrated in FIG. 5*b* are the electrostatic MEMS switch drive pads 570*a* and 570*b*, to which voltage is applied to cause motion of the movable MEMS switch element 410.

Figure 6:
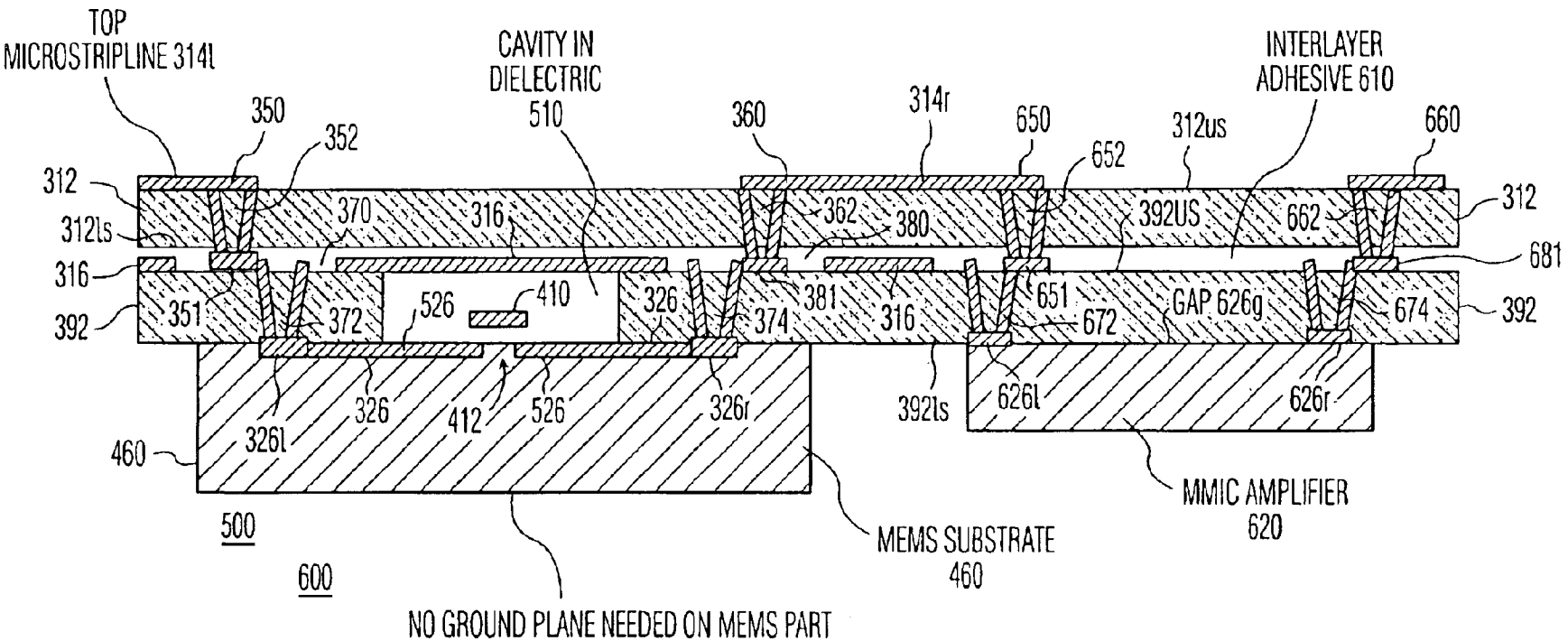
FIG. 6 is a simplified cross-sectional representation of a switch structure similar to that of FIG. 5*a*, with the addition of a further transmission line structure defining a gap and a MMIC electronic device making contact with at least side of the gap.

FIG. 6 is a simplified cross-sectional view of a switch 500 as described in conjunction with FIGS. 5*a* and 5*b*, with the addition of a monolithic microwave integrated circuit (MMIC) electronic device, thereby forming a structure 600 including a MEMS switch connected to a MMIC device by means of HDI connections. In FIG. 6, device 500 corresponds to the like element of FIG. 5, and a switched version of the signal applied to top microstripline 314*l* appears at microstripline 314*r*. In FIG. 6, MMIC element 620 is designated as being an amplifier, and is mounted below the lower surface 392*ls* of dielectric sheet or layer 392 with its input port 626*l* connected to pad 650 at the right end of strip conductor 314*r* by way of a combination of through via 652, pad 651, and through via 672. Similarly, the output port 626*r* of MMIC amplifier 620 is connected to a pad 660 on the upper surface 312*us* of dielectric layer 312 by way of a through via 662, a pad 681, and a further through via 674.

A salient advantage of at least some arrangements according to the invention lies in reduced electromagnetic reflections attributable to ground discontinuities or ground current reflections, which is particularly important in microwave applications.

Other embodiments of the invention will be apparent to those skilled in the art. For example, the "MMIC amplifier 620" could be, or include, a phase shifter, a low-noise amplifier, a power amplifier, filter components, or a further MEMS switch. The structure could include plural items corresponding to "MMIC amplifier 620," or more than one MEMS switch, or both. Adhesives may be used to join the various surfaces of the dielectric sheets and MEMS or other substrates.

Thus, a transmission-line structure according to an aspect of the invention comprises a first dielectric sheet (312) defining first (312*us*) and second broad (312*ls*) sides. The first broad side (312*us*) of the first dielectric sheet (312) bears first (314*l*) and second (314*r*) separate electrically conductive planar strips. Each of the separate electrically conductive planar strips defines at least a first end (350, 360, respectively). The first end (350) of the first planar strip (314*l*) and the first end (360) of the second planar strip (314*r*) are spaced apart by a distance (S1). A second dielectric sheet (392) defines first (392*us*) and second (392*ls*) broad sides. The first broad side (392*us*) of the second dielectric sheet (392) defines a single continuous electrical conductor (ground 316) which defines first (370) and second (380) nonconductive regions. The first and second nonconductive regions are spaced apart by about the distance (S1). The first broad side (392*us*) of the second dielectric sheet (392) is juxtaposed with the second broad side (312*ls*) of the first dielectric sheet (312), with at least portions of the first (370) and second (380) nonconductive regions of the continuous electrical conductor (316) registered with the first ends (350, 360) of the first (314*l*) and second (314*r*) planar strips, respectively. The transmission-line structure also includes a nonconductive planar surface (392*ls*; 460*us*) bearing a third electrically conductive planar strip (326) defining first (326*l*) and second (326*r*) ends. The first (326*l*) and second (326*r*) ends of the third planar strip (326) are separated by about the distance (S1). The nonconductive planar surface (392*ls*; 460*us*) is associated with the second side (392*ls*) of the second dielectric sheet (392), with the first (326*l*) and second (326*r*) ends of the third planar strip (326) registered with the first ends (350, 360) of the first (314*l*), and second (314*r*) planar strips, respectively. A first electrically conductive through via (352, 372) arrangement connects the first end (350) of the first planar strip (314*l*) to the first end (326*l*) of the third strip ($\mathbf{326}_L$) through the first nonconductive region (370). A second electrically conductive through via arrangement (362, 374) connects the first end (360) of the second planar strip (314*r*) to the second end (326*r*) of the third strip ($\mathbf{326}_R$) through the second nonconductive region (380), to thereby form the first (314*l*), second (314*r*) and third (326) planar strips into a continuous strip conductor in which at least a portion of each of the first (314*l*), second (314*r*) and third (326) planar strips overlies a side of the continuous electrical conductor (316) to thereby form a strip transmission line including at least portions of the first, second and third planar strips.

A preferred embodiment of the transmission-line structure further includes a gap (412) in the third planar strip (326), and mechanically operated switch means (410) making controllable electrical and mechanical contact with a portion (326*l*) (326*r*) of the third planar strip (326) on each side of the gap (412). In one version of this preferred embodiment, the mechanically operated switch means lies on a side of the gap (412) which is remote from the first dielectric sheet (312), and moves toward and away from the second dielectric sheet (392) in order to make and break connection. In another version of this preferred embodiment, the mechanically operated switch means lies within a cavity (510) defined in the second dielectric sheet (392).

Another embodiment of the transmission-line structure includes a gap (626*g*) in the third planar strip (626), and a planar signal processing module (620) with at least first (626*l*) and second (626*r*) signal ports. The first (626*l*) and second (626*r*) signal ports are mechanically and electrically connected to portions of the third planar strip (626*l*, 626*r*) on each side of the gap (626*g*). In a preferred version of this embodiment, the signal processing module (620) performs amplification, and the first and second signal ports are signal input and output ports, respectively.

What is claimed is:

1. A transmission-line structure, comprising:

a first dielectric sheet defining first and second broad sides, said first broad side of said first dielectric sheet bearing first and second separate electrically conductive planar strips, each defining at least a first end, said first end of said first planar strip and said first end of said second planar strip being spaced apart by a distance;

a second dielectric sheet defining first and second broad sides, said first broad side of said second dielectric sheet defining a single continuous electrical conductor which defines first and second nonconductive regions, which nonconductive regions are spaced apart by about said distance, said first broad side of said second dielectric sheet being juxtaposed with said second broad side of said first dielectric sheet with at least portions of said first and second nonconductive regions of said continuous electrical conductor registered with said first ends of said first and second planar strips, respectively;

a nonconductive planar surface bearing a third electrically conductive planar strip defining first and second ends, said first and second ends of said third planar strip being separated by about said distance, said planar surface being associated with said second side of said second dielectric sheet with said first and second ends of said third planar strip registered with said first ends of said first and second planar strips, respectively, said third electrically conductive planar strip being conductively isolated from said single continuous electrical conductor;

a first electrically conductive through via arrangement connecting said first end of said first planar strip to said first end of said third strip through said first nonconductive region; and a second electrically conductive through via arrangement connecting said first end of said second planar strip to said second end of said third strip through said second nonconductive region, to thereby form said first, second and third planar strips into a continuous strip conductor in which at least a portion of each of said first, second and third planar strips overlies a side of said continuous electrical conductor to thereby form a strip transmission line including at least portions of said first, second and third planar strips; further comprising:

a gap in said third planar strip; and mechanically operated switch means making controllable electrical and mechanical contact with a portion of said third planar strip on both sides of said gap.

2. A transmission-line structure, comprising:

a first dielectric sheet defining first and second broad sides, said first broad side of said first dielectric sheet bearing first and second separate electrically conductive planar strips, each defining at least a first end, said first end of said first planar strip and said first end of said second planar strip being spaced apart by a distance;

a second dielectric sheet defining first and second broad sides, said first broad side of said second dielectric sheet defining a single continuous electrical conductor which defines first and second nonconductive regions, which nonconductive regions are spaced apart by about said distance, said first broad side of said second dielectric sheet being juxtaposed with said second broad side of said first dielectric sheet with at least portions of said first and second nonconductive regions of said continuous electrical conductor registered with said first ends of said first and second planar strips, respectively;

a nonconductive planar surface bearing a third electrically conductive planar strip defining first and second ends, said first and second ends of said third planar strip being separated by about said distance, said planar surface being associated with said second side of said second dielectric sheet with said first and second ends of said third planar strip registered with said first ends of said first and second planar strips, respectively, said third electrically conductive planar strip being conductively isolated from said single continuous electrical conductor;

a first electrically conductive through via arrangement connecting said first end of said first planar strip to said first end of said third strip through said first nonconductive region; and a second electrically conductive through via arrangement connecting said first end of said second planar strip to said second end of said third strip through said second nonconductive region, to thereby form said first, second and third planar strips into a continuous strip conductor in which at least a portion of each of said first, second and third planar strips overlies a side of said continuous electrical conductor to thereby form a strip transmission line including at least portions of said first, second and third planar strips; further comprising a gap in said third planar strip; and mechanically operated switch means making controllable electrical and mechanical contact with a portion of said third planar strip on both sides of said gap, wherein said mechanically operated switch means lies on a side of said second dielectric sheet remote from said first dielectric sheet, and moves toward and away from said third planar strip to make contact with said third planar strip on each side of said gap.

3. A transmission-line structure according to claim 1, wherein said second dielectric sheet defines a cavity adjacent said gap; and said mechanically operated switch means lies within said gap, and moves toward and away from said gap in said third planar strip to make contact with said third planar strip on both sides of said gap.

4. A transmission-line structure according to claim 1, further comprising:

a further gap in said third planar strip; and a planar signal processing module including at least a first signal port, said first signal port being mechanically and electrically connected to said third planar strip on at least one side of said further gap.

5. A transmission-line structure according to claim 1, further comprising:

a gap in said third planar strip; and a planar signal processing module including first and second signal ports, said first and second signal ports being mechanically and electrically connected to said third planar strip on each side of said gap.

6. A transmission-line structure according to claim 5, wherein:

said signal processing module performs amplification; and said first and second signal ports are signal input and output ports, respectively.

* * * * *